United States Patent [19]

Young et al.

[11] Patent Number: 4,688,719

[45] Date of Patent: Aug. 25, 1987

[54] RAIL CLIP SUPPORT

[75] Inventors: Hartley F. Young, West Melton; John L. Collins, Ingle Farm, both of Australia

[73] Assignee: Ralph McKay Limited, Maidstone, Australia

[21] Appl. No.: 684,145

[22] Filed: Dec. 20, 1984

[30] Foreign Application Priority Data

Dec. 21, 1983 [AU] Australia ..... PG2944

[51] Int. Cl.[4] ..... E01B 9/30

[52] U.S. Cl. ..... 238/351; 238/350

[58] Field of Search ..... 238/338, 349, 350, 351

[56] References Cited

U.S. PATENT DOCUMENTS

| | | | |
|---|---|---|---|
| 2,954,169 | 9/1960 | Rigby | 238/351 X |
| 4,204,660 | 5/1980 | Feuillade | 238/350 X |
| 4,325,511 | 4/1982 | Young | 238/349 |
| 4,399,941 | 8/1983 | Lubbers | 238/351 X |
| 4,463,898 | 8/1984 | Young et al. | 238/351 X |

*Primary Examiner*—Randolph A. Reese
*Assistant Examiner*—Glenn B. Foster
*Attorney, Agent, or Firm*—Christel, Bean & Linihan

[57] ABSTRACT

A cast rail clip support of the kind used in concrete railway sleepers wherein one portion (17) of the rail clip is held in the rail clip support (19) and a second portion of the clip (16) bears down on the rail flange. The recess (26) of the rail clip support has slots (32) shaped to accommodate in a neat fit the base portion 17 of the rail clip. The clip when held in the recess 16 abuts the lower contact surface 33 and the end of the base portion 17 abuts the upper contact surface 34 which is inclined 3° above the horizontal. This arrangement presents the clip from being accidentally knocked from its position in the rail clip support.

3 Claims, 7 Drawing Figures

RAIL CLIP SUPPORT

Figure 1:
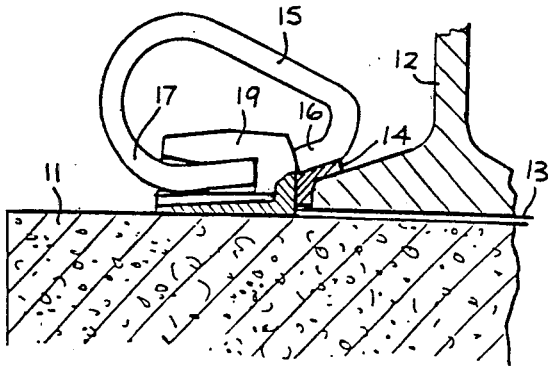

This invention relates to rail fastening systems and in particular to a support for an elastic rail clamp.

The Applicants earlier Australian Pat. No. 518,672 disclosed a cast support having an inclined surface to assist the raising of that portion of the elastic rail clip which lies on the rail flange. Conventionally rail ties are mostly formed from concrete and the rail clip supports are moulded into the cast concrete ties. A number of proposals have been made for the construction of these supports and include Australian patent applications 76330/81 (Pandrol) and 47728/79 (Everts).

In particular this invention is concerned with a fastener of the kind which is applied at right angles to the rail flange and has one portion lying on the rail flange exerting a hold down force and a second portion secured in the support which in turn is embedded in the rail tie. A problem associated with rail clips of this kind is that vibration of the rail tends to move the rail clip laterally off the rail flange. With rail clips of the kind described in U.S. Pat. Nos. 4,313,563 (Young), 3,067,947 (Deenik) and 3,881,653 (Jacobsen) where two resilient arms are part of the clip the support is usually designed to provide two abutting shoulders and an intermediate gap adjacent the rail flange to prevent withdrawal of the clip unless the arms are compressed together.

A difficulty arises with fastenings of this type when the elastic clip is struck in a particular position. Such impacts can occur during normal railway track maintenance operations such as ballast tamping. If a lateral clip is struck in such a manner that one arm is compressed and the clip as a whole is slewed so that the second arm no longer abuts a shoulder of the clip support, then both arms are free to pass between the shoulders of the clip support. In such circumstances the clip is likely to slide off the rail flange and be dislocated.

It is an object of this invention to provide a rail clip support which is able to prevent accidental dislocation of the rail clip.

Australian specification 27483/84 by the present applicant provides as one solution to this problem the provision of a projection on the support shoulder which lies between the free arms of the rail clip to prevent its movement off the shoulder.

This invention provides an alternative means of avoiding accidental removal of the clip.

To this end the present invention provides a support for an elastic rail clip comprising a first portion adapted to secure said support to a rail tie and a second portion adapted to receive and hold a base portion of a rail clip of the kind having two free arms which lie on the rail flange, said second portion of said support comprising a recess laterally disposed to said rail flange, said recess providing a neat fit about the base portion of said clip.

The rail clips of the kind mentioned above are generally wider at their base than at the free ends and the recess is generally arranged to accommodate the widest portion of the clip. This means that the rear portion of the clip has a clearance from the side of the recess. Such a clearance enables the clip to obtain sideways acceleration after being struck parallel to the rail. If no such clearance is provided accelerated movement of the free ends of the clip is retarded and the clip is less likely to move laterally off the rail.

In another aspect this invention provides a rail fastening system comprising a rail clip and a rail clip support, said rail clip being applied laterally to the rail and having one portion adapted to seat on the rail flange and a second portion adapted to seat within a recess of a rail clip support, said clip support comprising one portion secured to the rail tie and a clip receiving portion adjacent the rail flange, to receive said second portion of the rail clip when it is laterally applied to the flange of the rail wherein said recesses shaped to provide a neat fit about the peripheral surface of said second portion of the rail clip.

A neat fit between the base of the clip and the recess of the support is best obtained by making them of complementary shape. The base of the clip is preferably of even width over that portion of the base which fits within the recess. More preferably the base is tapered in width and narrows towards its end. With a complementary narrowing recess a wedge type fit is achieved.

One reason why the clip is likely to move laterally off the rail is that the rail flange and the insulator which lies between the rail flange and the free ends of the clip is inclined from 11° to 14° to the horizontal. The rail clip insulators are usually composed of plastic such as nylon.

The low co-efficient of friction on the nylon causes a net force forcing the toes down the incline which increases the velocity of the toes when the clip is struck sideways and increases the tendency for the clip to come off.

The clip base is held in a socket in the shoulder and the front top face provides the greatest reaction of the 3 clip points of contact. This is the contact point of the top edge of the end of the base section of the clip.

It has been found practicable to incline this face 3° or more in the same direction as the rail flange which causes a force urging the clip to move in the opposite direction to that caused by the incline on the rail flange. This is because the clip acts on top of the inclined rail flange and below the inclined clip slot. This provides a resistance additional to that produced by the friction between the clip and its support.

This combined resistance prevents outward movement of the clip when subject to the static load system. When the clip is struck sideways the resisting forces are high enough to retard the movement and thereby reduce the final velocity at which the free arms of the clip strike the gate of the support. This substantially resists the tendency for the clip to move off the rail and allows wider tolerances to be used in making the mating parts of the socket.

A preferred embodiment of this invention will now be described with reference to the drawings.

Figure 2:
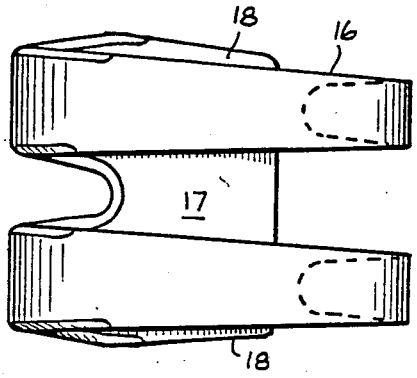
Figure 3:
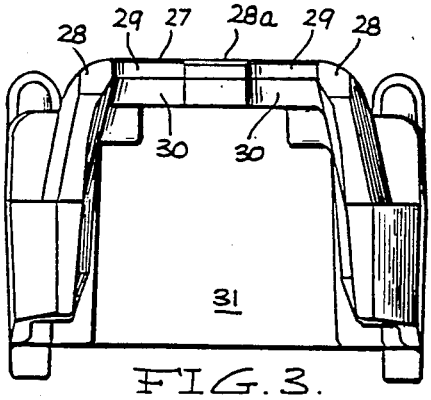
Figure 4:
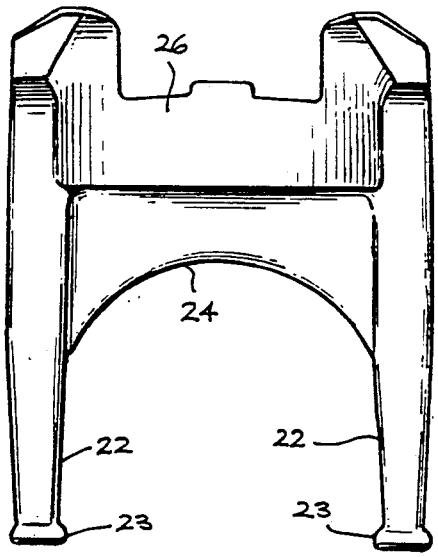
Figure 5:
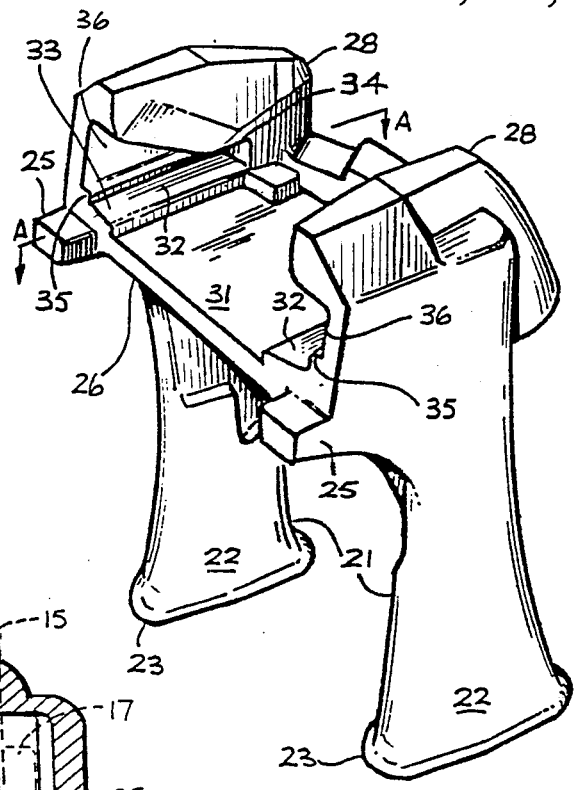
Figure 6:
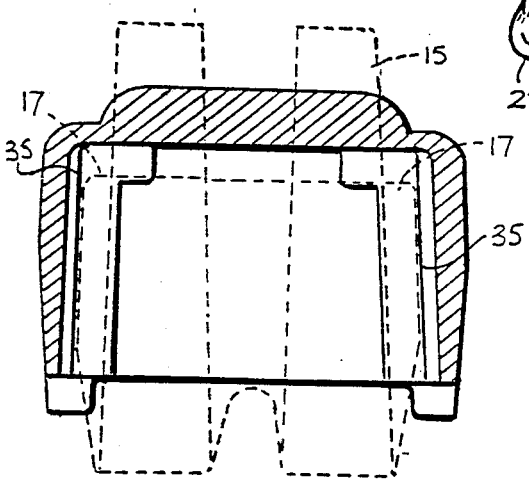
Figure 7:
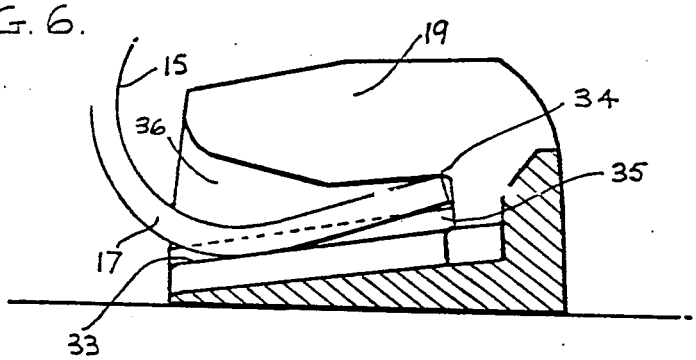

FIG. 1 is a schematic sectional view showing a rail support embedded in a concrete tie with a clip in position, FIG. 2 is a plan view of a rail clip showing the shape of the base portion thereof, FIG. 3 is a plan view of the support, FIG. 4 is a front view of the support, FIG. 5 is a perspective view of the clip support, FIG. 6 is a sectional plan view along A—A of FIG. 5 and FIG. 7 is a detailed sectional view of the clip base within the clip holder.

As seen in FIG. 1, the rail seat comprises a rail tie 11, a rail 12, a tie pad 13, a rail insulator 14, a rail clip 15 comprising a portion 16 consisting of two free arms which bears on the rail flange and a portion 17 which seats within the clip support 19. The rail clip is preferably of the kind described in U.S. Pat. No. 4,313,563.

The support 19 comprises the tie securing section 21 and the clip receiving portion 26. The section 21 which is embedded in the concrete tie 11 comprises a pair of legs 22 having extended feet 23 and which are joined by web 24. The feet 23 resist any tendency for the support to be pulled out of the tie. Web 24 with the provision of the two legs ensures that the support will not twist or skew within the tie. The support is embedded in the tie up to the ribs 25.

When positioned in the tie the face 27 lies adjacent the rail and is shaped to fit within the insulator 14. From the front the support is seen to have two shoulders 28 and between them a gate 29 through which passes the portion of the arms of the rail clip which lies on the rail flange. This gate 29 is divided into two sections by the upstanding central flange 28*a*. Leading up to the horizontal edge of the gates 29 are ramps 30 which assist in raising the portion 16 of the rail clip as it is pushed toward the rail flange of rail 12. In the rail seat the edge of the horizontal gates 29 lie above the rail flange. Each arm of rail clip portion 16 passes up ramp 30 and through one of the respective gates 29 and when in position abuts the outer face of a shoulder 28 which abutment prevents withdrawal of the clip 15.

The rail clip 15 as shown in FIG. 2 has an overall taper from the base 17 to the ends of the twin arms 16 but incorporates a reverse taper on the edge portions 18 which fit into the recess of the support.

The receiving portion 26 of the support 19 comprises a base 31 clip guideways 32 on either side of the support 19 located behind shoulders 28 and each guideway 32 being defined by a lower contact surface 33 and an upper contact surface 34 and a side wall 36 having a lower step 35. The support 19 is usually set into the rail tie so that the lower surfaces 33 and the base 31 slope rearwardly to allow drainage.

The guideways 32 as defined by the stepped side walls 35, are inclined inwardly towards gates 29 as shown in FIG. 6. This tapering of the recess between the stepped side walls 35 complement the tapering of edges 18 of the clip 15 to provide a neat fit with minimal clearance.

The upper contact surface 34 is inclined at least 3° to the horizontal in the same direction as the inclination of the rail flange. This means that contact between base 17 and surface 34 produces a resultant force opposite in direction to the force produced by contact between the insulator 14 and the clip arms 16 which will retard lateral movement of the clip off the rail flange.

This construction is particularly useful with a cast rail support because of the difficulty of controlling tolerances in casting. By providing a complementary taper to the recess of the rail clip differences in dimension caused by variations in casting will not seriously prevent a neat fit being obtained. The provision of the step 35 in the side wall 36 of the guideway 32 similarly avoids difficulties in inserting the clips due to rough surfaces formed in casting. The height of the step 35 need only be no more than half the thickness of the base section 17 of the rail clip in order to space the clip away from the side walls 36 of guideway 32.

From the above description it can be seen that the present invention provides an arrangement which inhibits accidental removal of laterally disposed rail clips from their associated supports.

The claims defining the invention are as follows.

We claim:

1. A rail fastening system comprising a rail clip and a rail clip support, said rail clip being applied laterally to the rail and having one portion comprising two free arms adapted to seat on the rail flange and a second portion, adapted to seat within a recess of a rail clip support, said clip support comprising one portion secured to the rail tie and a clip receiving portion adjacent the rail flange, to receive said second portion of the rail clip when it is laterally applied to the flange of the rail wherein the terminal edge of said second portion of said rail clip abuts an upper surface portion of said recess which surface portion is inclined to the horizontal in the same direction as the inclination of the upper surface of the rail flange and said recess is shaped to provide a wedge fit about the side edges of said second portion of the rail clip, the side walls of said recess tapering inwardly toward the end wall of said recess and said second portion of the rail clip having a complementary taper.

2. A rail fastening system as claimed in claim 1 wherein said inner end of the recess is inclined at least 3° above a horizontal plane parallel to the rail tie.

3. A rail clip support for use in a rail fastening system comprising a rail clip and said support, the rail clip being applied laterally to the rail and having one portion comprising two free arms adapted to seat on the rail flange and having a second portion, said clip support comprising a body having one portion secured to the rail tie and a clip receiving portion adjacent the rail flange, said clip receiving portion including a recess to receive the second portion of the rail clip when it is laterally applied to the flange of the rail wherein the terminal edge of the second portion of the rail clip abuts an upper surface portion of said recess which surface portion is inclined to the horizontal in the same direction as the inclination of the upper surface of the rail flange and said recess is wedge shaped to provide a wedge fit about the side edges of the second portion of the rail clip, the side walls of said recess tapering inwardly toward the end wall of said recess and the second portion of the rail clip having a complementary taper.

* * * * * *